US010130836B2

(12) United States Patent
Madion

(10) Patent No.: US 10,130,836 B2
(45) Date of Patent: Nov. 20, 2018

(54) EXERCISE WEDGE

(71) Applicant: Megan A. Madion, Traverse City, MI (US)

(72) Inventor: Megan A. Madion, Traverse City, MI (US)

( * ) Notice: Subject to any disclaimer, the term of this patent is extended or adjusted under 35 U.S.C. 154(b) by 36 days.

(21) Appl. No.: 15/485,200

(22) Filed: Apr. 11, 2017

(65) Prior Publication Data

US 2017/0291055 A1 Oct. 12, 2017

Related U.S. Application Data

(60) Provisional application No. 62/321,461, filed on Apr. 12, 2016.

(51) Int. Cl.

| | |
|---|---|
| ***A63B 21/002*** | (2006.01) |
| ***A63B 21/00*** | (2006.01) |
| ***A63B 23/00*** | (2006.01) |

(52) U.S. Cl.

CPC .... *A63B 21/00047* (2013.01); *A63B 21/4039* (2015.10); *A63B 23/00* (2013.01); *A63B 21/0023* (2013.01)

(58) Field of Classification Search

CPC ... A63B 21/00; A63B 21/00047; A63B 23/00; A63B 23/16; A63B 23/12; A63B 23/14; A63B 23/1209; A63B 23/1227; A63B 23/1236; A63B 21/403; A63B 21/4027

See application file for complete search history.

(56) References Cited

U.S. PATENT DOCUMENTS

| | | | | |
|---|---|---|---|---|
| 3,376,920 | A * | 4/1968 | Lazarus | H01L 23/4093 165/185 |
| 5,125,123 | A * | 6/1992 | Engle | A47C 20/025 128/845 |
| 5,431,618 | A * | 7/1995 | Levi | A63B 21/00047 482/142 |
| 5,476,105 | A * | 12/1995 | Toth | A47C 20/021 128/DIG. 20 |
| 5,607,380 | A * | 3/1997 | Duty | A63B 21/00047 482/126 |
| 5,647,829 | A * | 7/1997 | Rivas | A63B 23/0211 482/140 |
| 5,871,457 | A * | 2/1999 | Swedberg | A47C 20/021 128/845 |
| 6,371,894 | B1 | 4/2002 | Hill | |
| 6,640,368 | B2 * | 11/2003 | Roston | A47C 20/021 5/648 |
| 6,942,605 | B1 * | 9/2005 | Sukhovitsky | A63B 21/0004 2/24 |

(Continued)

*Primary Examiner* — Garrett Atkinson

(74) *Attorney, Agent, or Firm* — Northern Michigan Patent Law, PLC

(57) ABSTRACT

A foam exercise block in the shape of a wedge having an inclined front face, a vertical rear face, and a bottom face defining forward, upper, and rear edges. A ball socket is formed in the front face, and upper and lower semi-circular grooves running between the front and rear faces at the upper and forward edges of the wedge provide support for an exercise ball and portions of the body. The continuity of the lateral edges at their ends is interrupted by right-angled cutouts to provide corner handholds for various exercises using the wedge as a brace against a flat surface.

11 Claims, 12 Drawing Sheets

(56) References Cited

U.S. PATENT DOCUMENTS

| | | | | |
|---|---|---|---|---|
| 7,063,646 | B1 * | 6/2006 | Slimi | A63B 22/14 482/141 |
| 7,966,679 | B2 | 6/2011 | Sakata et al. | |
| 8,322,343 | B2 * | 12/2012 | Cardin | A61H 1/0237 128/845 |
| 8,376,920 | B2 | 2/2013 | Anderson | |
| D681,751 | S | 5/2013 | Meyer-Hayoz | |
| D711,000 | S | 8/2014 | Ravikumar et al. | |
| D728,270 | S | 5/2015 | Hauer | |
| 9,220,359 | B2 | 12/2015 | Long | |
| 2004/0121888 | A1 * | 6/2004 | Williams | A63B 21/028 482/121 |
| 2005/0020417 | A1 | 1/2005 | Gary | |
| 2006/0089241 | A1 * | 4/2006 | Klein | A63B 21/00047 482/141 |
| 2007/0117695 | A1 * | 5/2007 | Endelman | A63B 21/00047 482/140 |
| 2007/0173391 | A1 * | 7/2007 | Edwards | A63B 21/00047 482/142 |
| 2008/0096740 | A1 | 4/2008 | Nichols | |
| 2009/0209373 | A1 * | 8/2009 | Brodmann | A63B 60/10 473/526 |
| 2012/0214653 | A1 * | 8/2012 | Tsou | A63B 21/00047 482/142 |
| 2013/0252791 | A1 * | 9/2013 | Chang | A63B 22/20 482/132 |
| 2013/0274078 | A1 * | 10/2013 | Andrews | A63B 23/1227 482/141 |

* cited by examiner

EXERCISE WEDGE

RELATED APPLICATIONS/PRIORITY BENEFIT CLAIM

This application claims the benefit of U.S. Provisional Application No. 62/321,461, filed Apr. 12, 2016 by the same inventor (Madion), the entirety of which provisional application is hereby incorporated by reference.

FIELD

The subject matter of the present application is in the field of resilient wedges and blocks used to support a human body while performing exercises.

BACKGROUND

Exercise blocks made from firm-but-resilient materials such as foam rubber and equivalents are known, and come in a variety of shapes (wedges, blocks, curved saddles, etc.—hereafter "blocks" for convenience). These prior exercise blocks are often limited to helping the user perform a single exercise, or a small set of closely related exercises, and are accordingly limited in usefulness. Prior exercise blocks also seem to be generally meant for standalone use, i.e. not designed to interact with other exercise devices and supports commonly found in exercise studios and gyms.

BRIEF SUMMARY

I have invented an exercise block made from a firm-but-resilient foam type material, useful for a wide variety of floor, wall, and ball exercises and stretches. The exercise block comprises a generally triangular wedge of relatively dense polymer foam, the wedge having an inclined front face, a vertical rear face, a bottom face or base, and three horizontal edges defined at the junctions or vertices of the faces: forward, upper, and rear. The inclined front face includes a hemispherical ball socket. The horizontal edges of the faces are interrupted at their outer corners by right-angled cutouts, and at their centers by semi-circular channels or grooves extending from the front face to the rear face.

In a further form, the forward edge corner cutouts comprise vertical faces, while the upper and rear edge corner cutouts are inclined rearwardly so as to be generally perpendicular to their respective edges.

In a further form, the ball socket on the inclined front face of the wedge is located above the center of the front face. In yet a further form, the upper edge's semi-circular groove has a smaller radius than the forward edge's semi-circular groove.

The invention also includes specific methods of using the exercise wedge for 1) floor exercises with an exercise ball, and 2) wall exercises that replace the need for a wall-mounted bar.

Terms of orientation used for various features on the wedge, such as vertical, horizontal, upper, lower, etc., are initially applied assuming a base orientation of the wedge with the bottom face on the floor, and will generally be used regardless of changes from this basic orientation when the wedge is in use.

These and other features and advantages of the invention will become apparent from the detailed description below, in light of the accompanying drawings.

DETAILED DESCRIPTION

Figure 1:
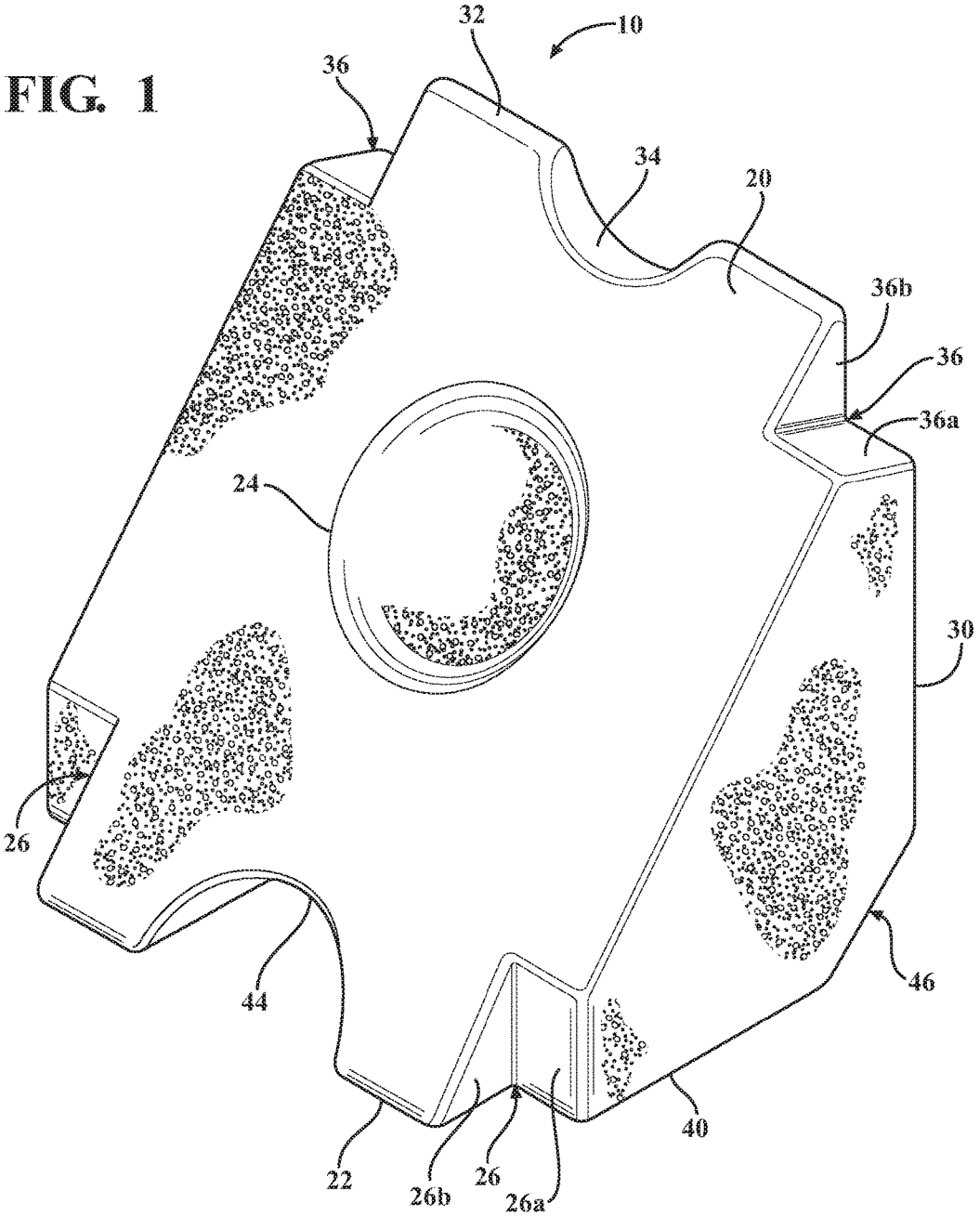
FIG. 1 is a front perspective view of an illustrative example of an exercise wedge according to the invention.
Figure 2:
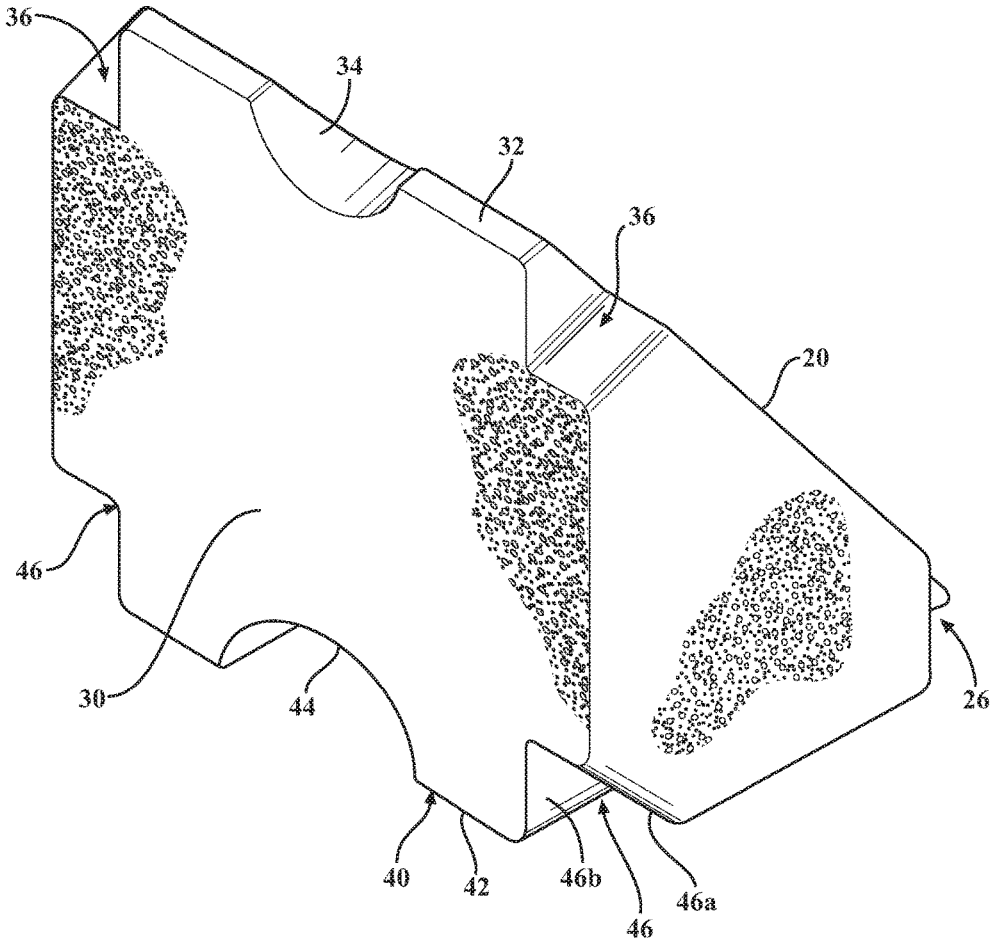
FIG. 2 is a rear perspective view of the wedge of FIG. 1, from the opposite angle.
Figure 3:
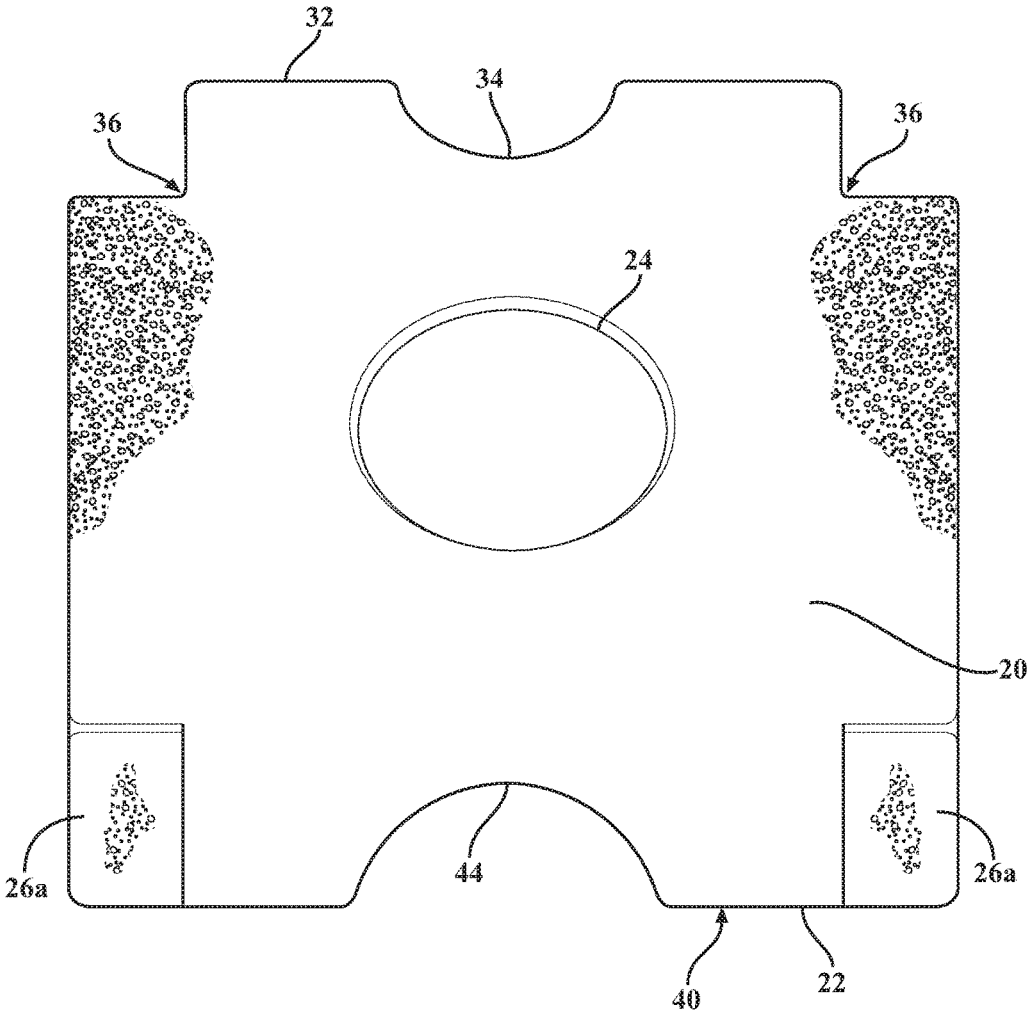
FIG. 3 is a front elevation view of the wedge of FIG. 1.
Figure 4:
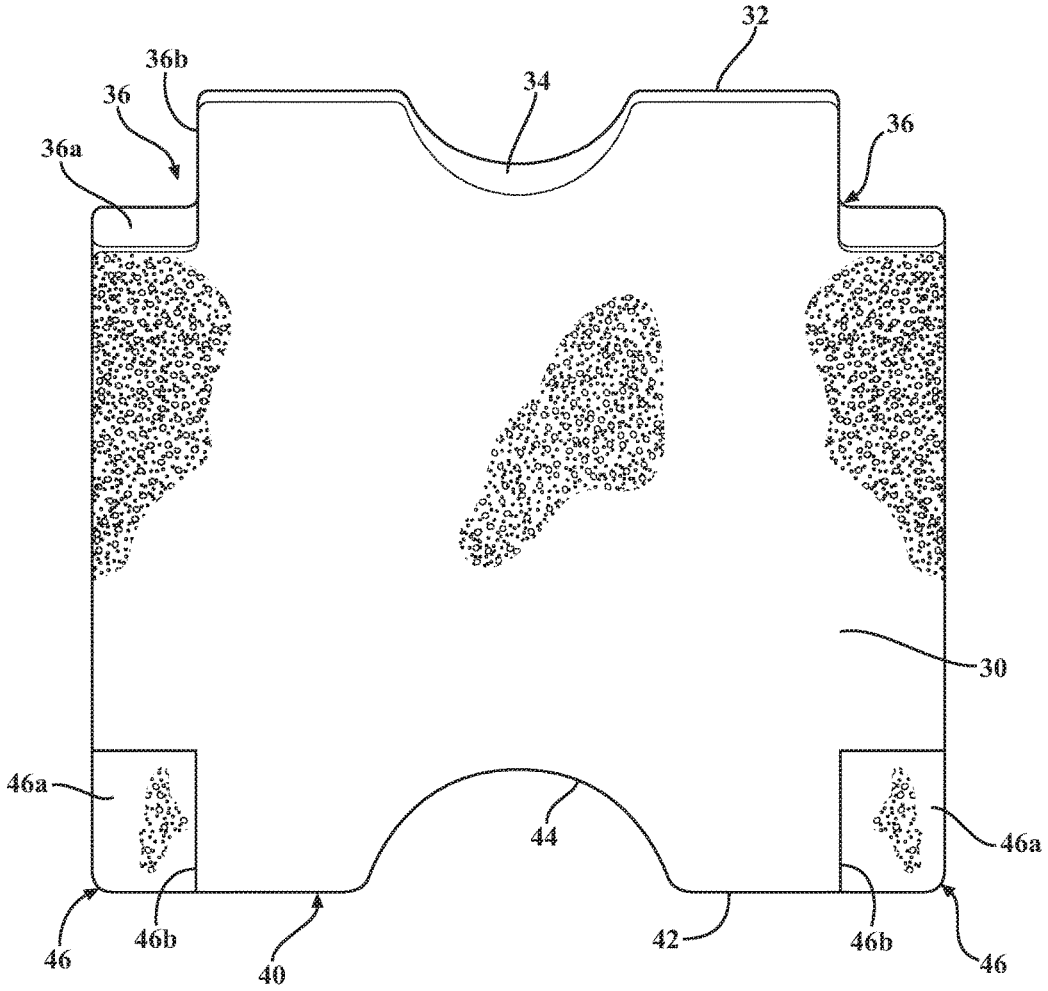
FIG. 4 is a rear elevation view of the wedge of FIG. 1.
Figure 5:
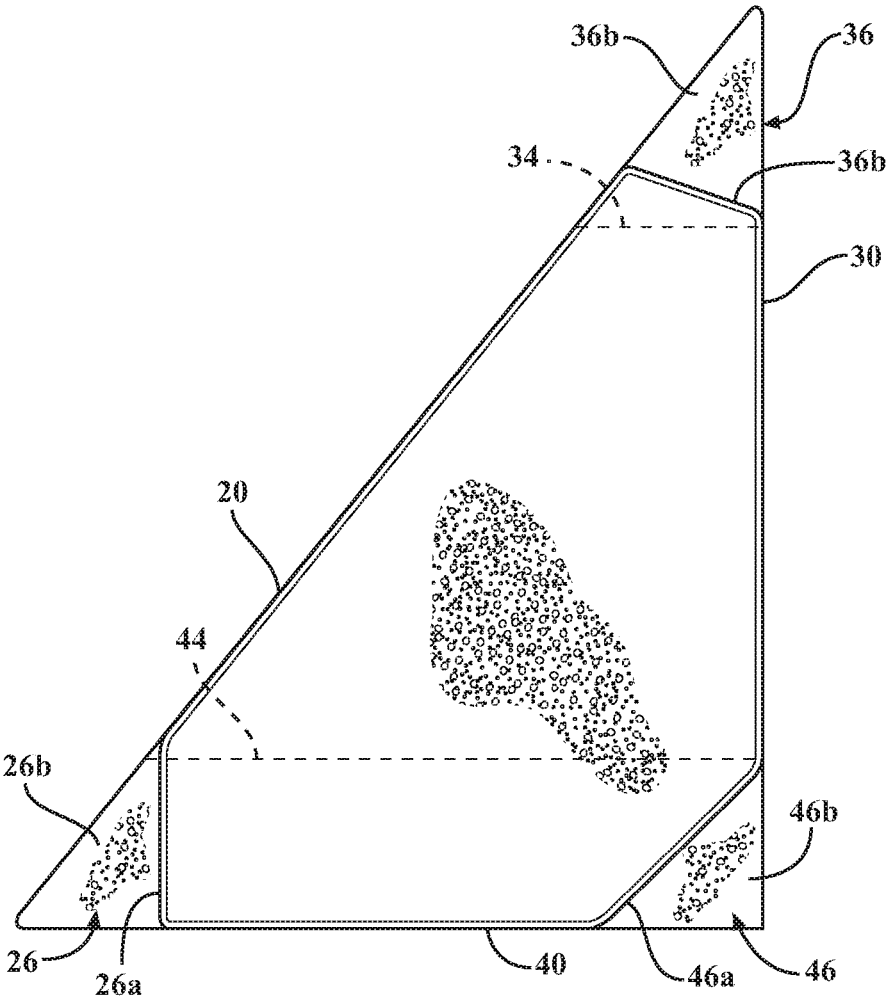
FIG. 5 is a left side elevation view of the wedge of FIG. 1.
Figure 6:
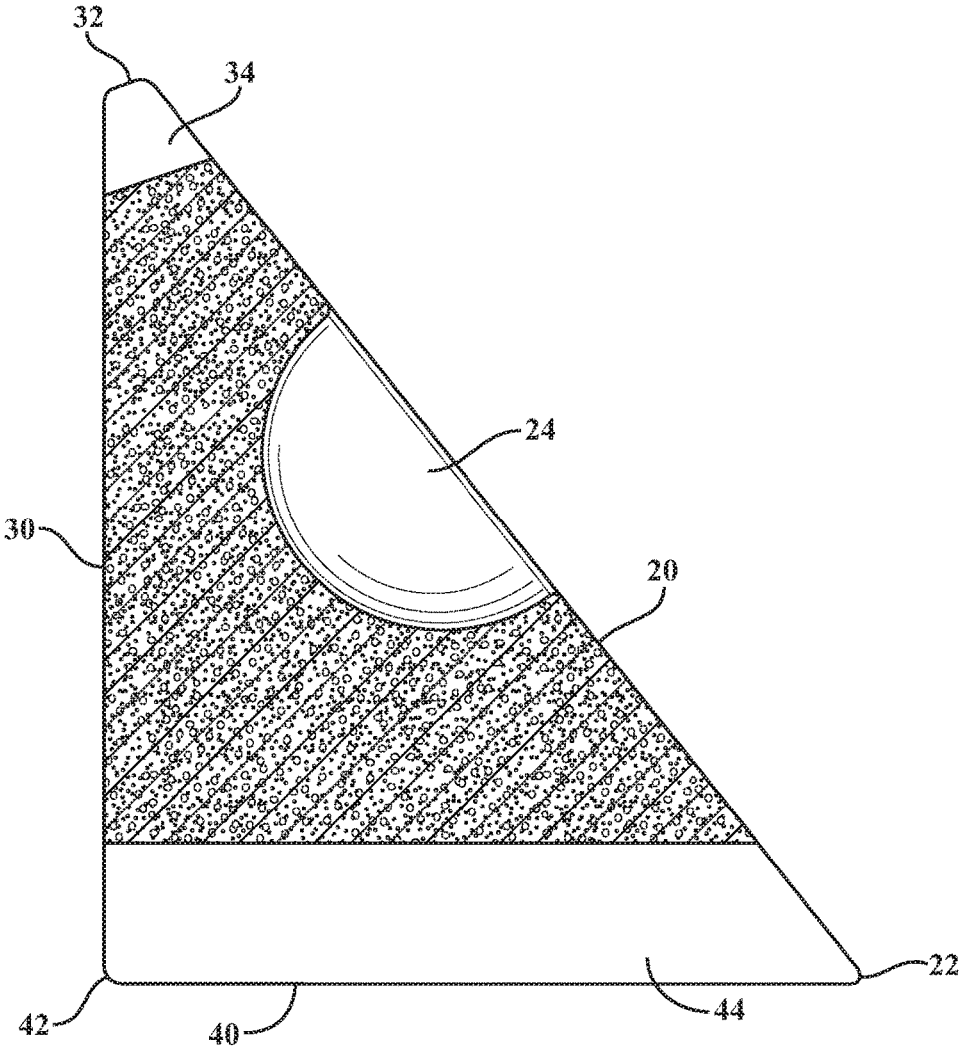
FIG. 6 is a right side elevation view of the wedge of FIG. 1, sectioned through the center of the wedge.
Figure 7:
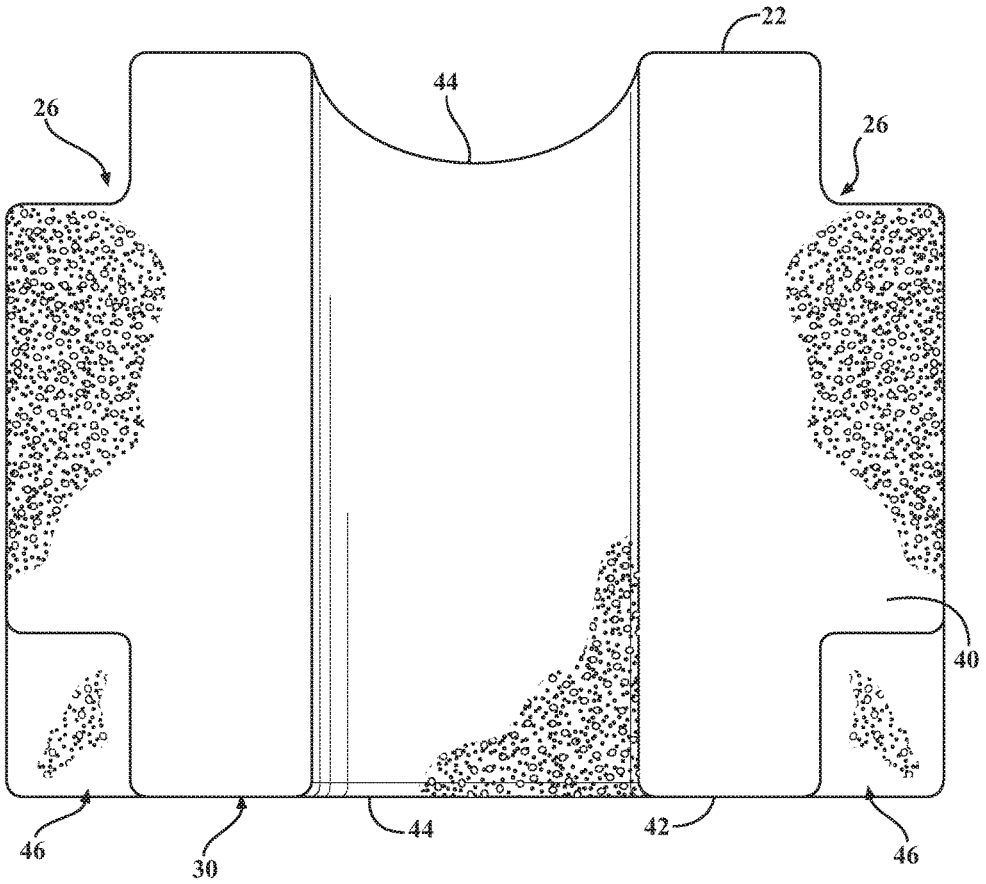
FIG. 7 is a bottom plan view of the wedge of FIG. 1.

Referring first to FIGS. 1 through 8, a firm-but-resilient foam block or wedge 10 is shown in exemplary form in order to teach how to make and use the claimed invention. Wedge 10 is generally triangular in section when viewed from the side, and may be made from a one-piece body of relatively dense EVA foam of the type commonly known for exercise and yoga blocks and supports. It will be understood that the material for wedge 10 may vary using known foam and other materials capable of being formed into a well-defined shape, and capable of providing a resilient support for the weight of a human body while exercising. Wedge 10 may also be made from more than one type of material, for example with layers or sections of foam having different densities.

Wedge 10 has an inclined front face 20, for example inclined about 30-45 degrees from vertical, although the angle may be varied; a vertical rear face 30; and a horizontal bottom face 40. Faces 20, 30, and 40 define three horizontal side-to-side (lateral) edges at their junctions: forward edge 22, upper edge 32, and rear edge 42. In general proportion, bottom face 40 has the shortest length, rear face 30 is the next longest, and front face 20 has the greatest length. Example dimensions are 9.5 inches for the bottom face 40, 12.0 inches for the rear face 30, and 15.5 inches for the front face 20. These proportions and dimensions are preferred, but the wedge is not limited to these.

Inclined front face 20 includes a generally hemispherical ball socket 24, sized to receive a portion of an exercise ball so that approximately half or more of the ball protrudes from the socket. Illustrated ball socket 24 is centered with respect to the left and right sides of the wedge, and located with its center above the center of front face 20, i.e. closer to upper edge 32 than to forward edge 22. The diameter and depth of socket 24 may vary depending on the preferred size of exercise balls with which the wedge is intended to be used.

Forward edge 22 is interrupted at its center by a generally semi-circular horizontal bottom groove 44 extending from front face 20 to rear face 30 on an axis parallel to bottom face 40. Bottom groove 44 is centered left-right on bottom face 40, i.e. aligned with ball socket 24, and generally has a similar depth/diameter as socket 24 in order to receive a portion of the same exercise ball received by socket 24. The depth/diameter of bottom groove 44 is also sufficient to support curved portions of a person's torso and legs.

Forward edge 22 is additionally interrupted at each end by a forward cutout 26 defining generally perpendicular vertical faces 26*a* and 26*b*.

Upper edge 32 is interrupted at its center by a generally semi-circular upper groove 34 extending from front face 20 to rear face 30, with an axis perpendicular to inclined front face 20, resulting in the groove being inclined rearwardly from vertical. Upper groove 34 is shown smaller in diameter/depth than groove 44, as it is designed primarily to cradle a narrower portion of a person's body, such as the neck, rather than an exercise ball.

Upper edge 32 is additionally interrupted at each end by an upper cutout 36 defining generally perpendicular inclined faces 36*a* and 36*b*.

Rear edge 42 is interrupted at its center by groove 44, which extends along the entirety of bottom face 40. Rear edge 42 is additionally interrupted at each end by a rear cutout 46 defining a vertical face 46*a* and a rearwardly inclined face 46*b*, generally perpendicular to each other.

Front, rear, and bottom faces 20, 30, and 40 are generally flat in order to provide a stable resting surface when placed against floors and walls.

Figure 8:
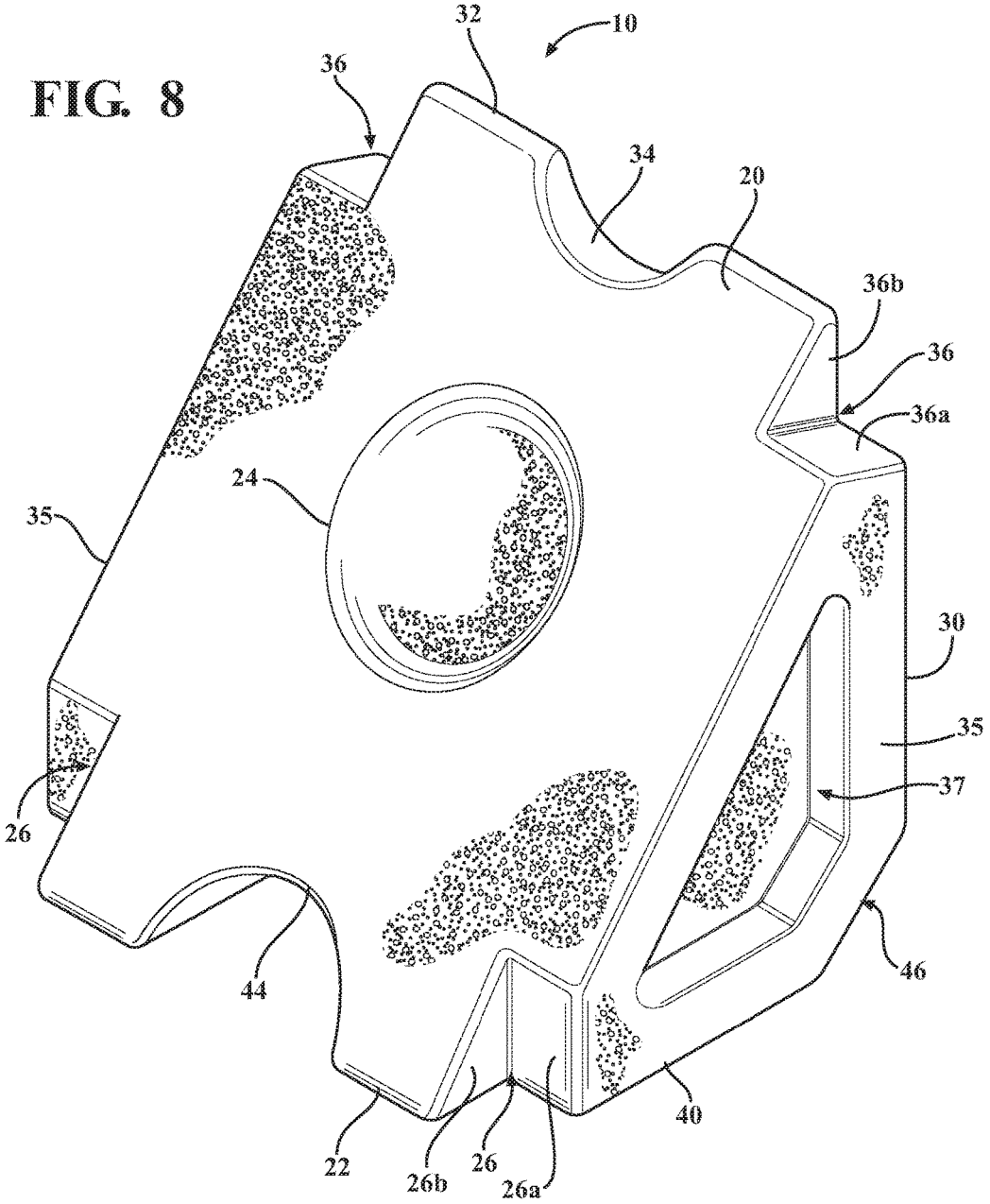
FIG. 8 is a front perspective view of the wedge of FIG. 1, modified with a decorative side indentation.

FIG. 8 shows an alternate embodiment of wedge 10 in which each side face 35 is provided with a recessed region 37 generally following the contours of the side faces. Recessed region 37 is primarily decorative, but might provide useful handholds for certain exercises.

Referring next to FIGS. 9-14, wedge 10 is shown in use for various exercises specific to wedge 10, and interacting with various supports and equipment found in a gym or exercise studio.

Figure 9:
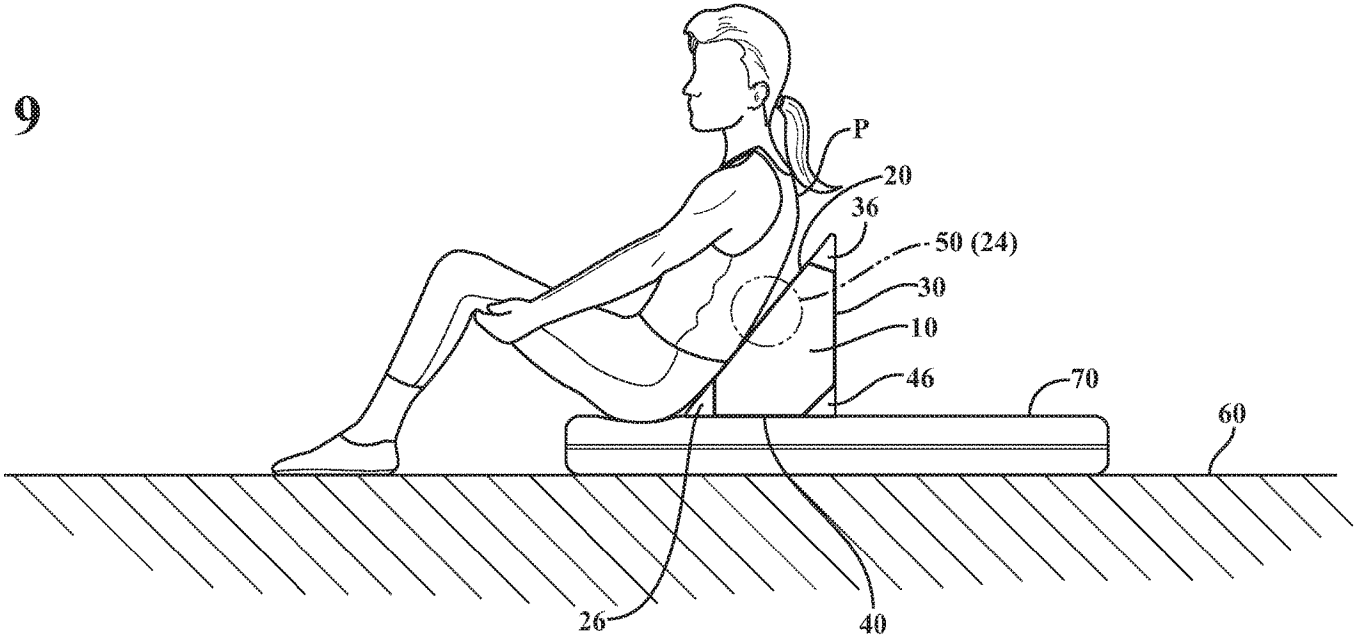
FIG. 9 illustrates an exercise in which a ball is placed in the ball socket for an abdominal exercise.

In FIG. 9, a person P is shown performing an abdominal exercise in which bottom face 40 of wedge 10 is on the floor or mat, and a resilient exercise ball 50 of known type is placed in the wedge's ball socket 24 on front face 20. Ball 50 presses a person's upper back forward, allowing the person to push the low abs into the wedge for deeper engagement of the transverse abdominus.

Figure 10:
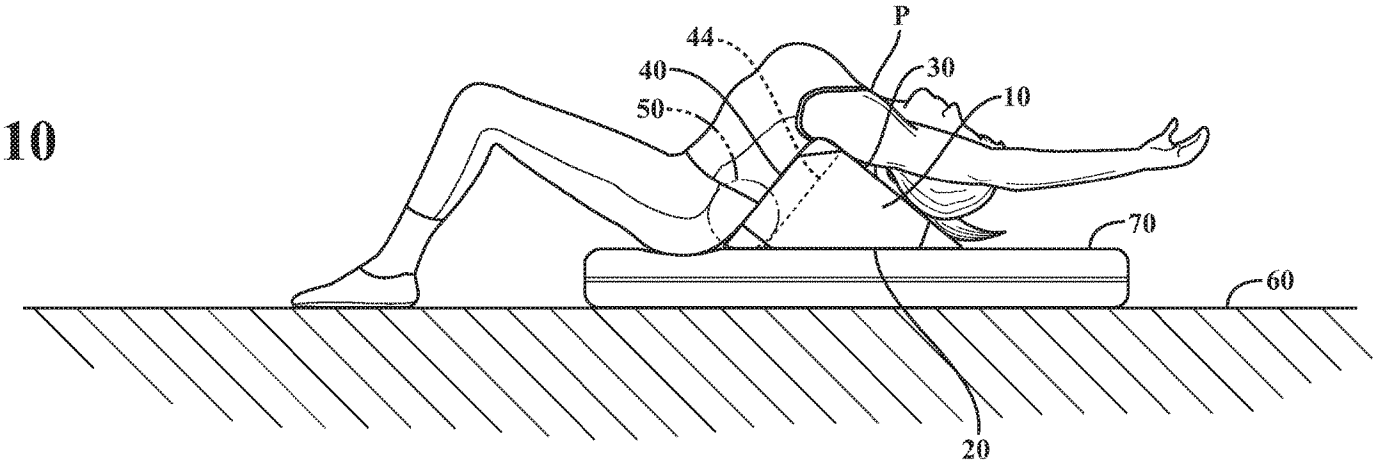
FIG. 10 illustrates an exercise in which the ball is placed in the bottom groove between the wedge and the mat for a back stretch exercise.

In FIG. 10, person P is shown performing a back stretch exercise in which the front inclined face 20 of wedge 10 is placed on the mat or floor, and a ball 50 is placed in the lower end of bottom groove 44 between the wedge 10 and the mat or floor for a back stretch exercise. The mutual support of ball 50 between the person's back, the floor, and the wedge provides superior stability for the back during stretching.

Figure 11:
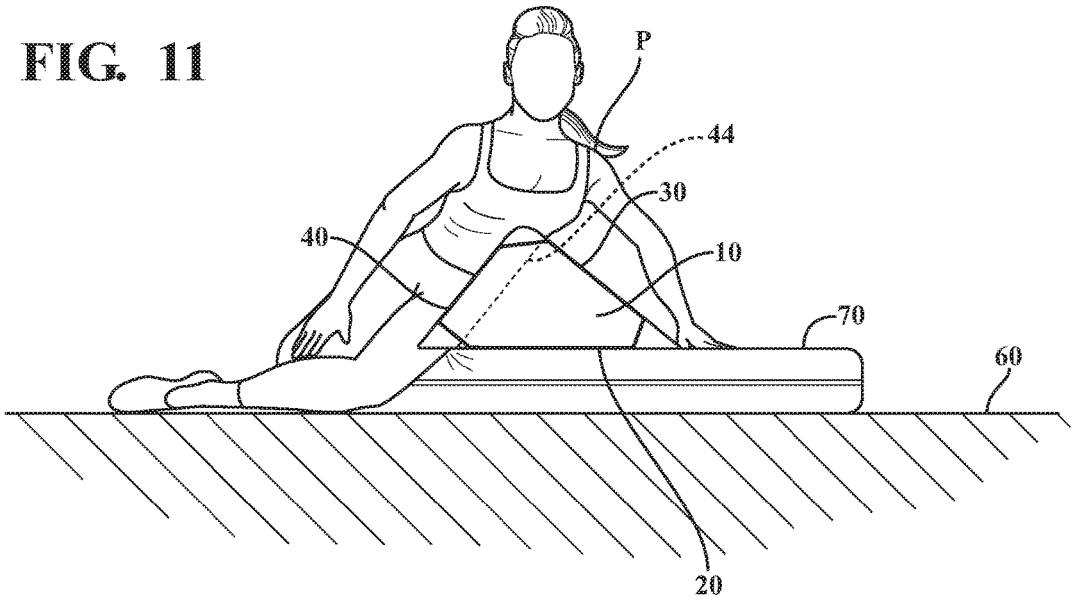
FIG. 11 illustrates an exercise in which a person's side is braced in the bottom groove for an oblique exercise.

In FIG. 11, person P is shown performing an exercise in which the wedge front face 20 is on the mat/floor, and the person's side is braced or cradled in bottom groove 44 for an oblique exercise. The full-length curved support of groove 44 allows safe placement of the waist, and further allows the person to sit up higher for a deeper target in the oblique.

Figure 12:
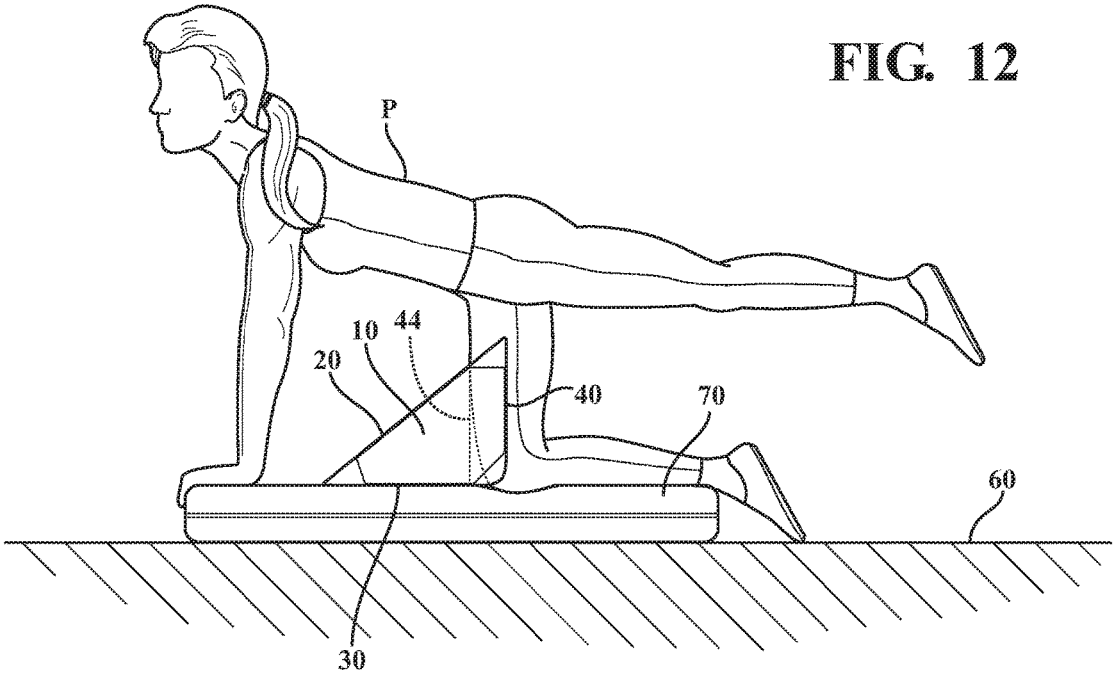
FIG. 12 illustrates an exercise in which a person's thigh is placed in the bottom groove for a leg lift exercise.

In FIG. 12, person P is shown performing a leg lift exercise in which wedge 10 is upright, with bottom face 40 on the mat or floor, and the person's non-lifted or base leg thigh is placed in the bottom groove 44. This position properly aligns the hip directly over the knee of the base leg while lifting the other leg.

Figure 13:
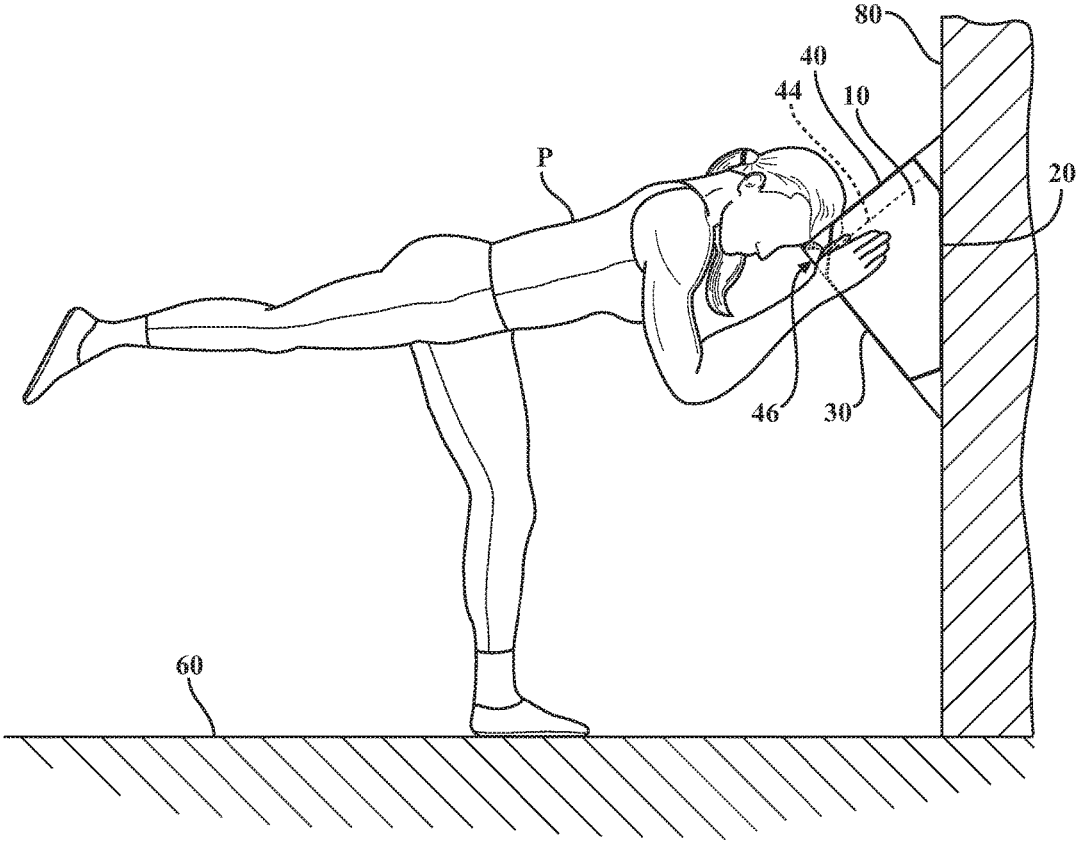
FIG. 13 illustrates an exercise in which the bottom groove allows comfortable placement for the forehead for a wall-based leg exercise.

In FIG. 13, person P is shown performing a wall-based or "bar" type leg lift exercise in which front face 20 of the wedge is placed flat against the wall 80. Bottom groove 44 allows comfortable placement for the forehead to provide proper body alignment. Rear edge cutouts 46 provide a solid grip for hands to insure better tension against the wall. The resulting support stabilizes the body to effectively target the glute and hamstring in a leg lift.

Figure 14:
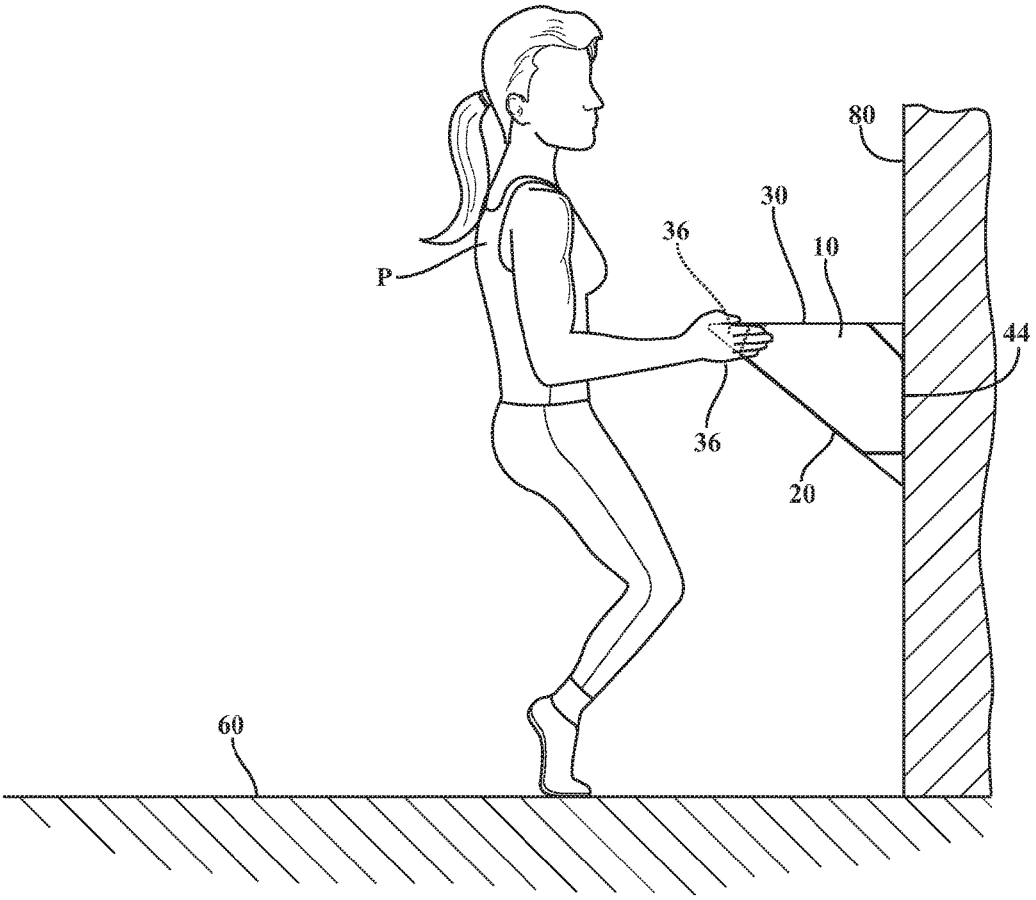
FIG. 14 illustrates an exercise in a wedge tabletop position for a different wall-based leg exercise.

In FIG. 14, person P is shown performing an exercise with the wedge in a "tabletop" position, with bottom face 40 flat against wall 80, for a different wall-based leg exercise. Upper edge hand cutouts 36 allow for stability so that the person can comfortably come up on the balls of the feet to effectively engage the thighs.

It will be understood that while the above exercises are especially enhanced by wedge 10, the wedge will be useful for a variety of exercises requiring support and stability for a person's body relative to a wall, mat or floor.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. An exercise wedge comprising:

a generally triangular wedge of firm-but-resilient polymer foam, the wedge comprising a generally flat bottom face, a generally flat vertical rear face, a generally flat inclined front face, and upper, forward, and rear lateral edges defined at the junctions of the faces;

a substantially hemispherical ball socket formed in the front face;

a substantially semi-circular bottom groove extending from the front face to the rear face along the bottom face, the bottom groove having an axis substantially parallel to the bottom face and interrupting the forward and rear lateral edges;

a substantially semi-circular upper groove extending from the front face to the rear face at the upper lateral edge, the upper groove interrupting the upper edge; and, wherein the upper, forward, and rear lateral edges are further interrupted at each of their ends by a handhold cutout.

2. The exercise wedge of claim 1, wherein the handhold cutout formed at each end of the upper, forward, and rear lateral edges comprises a pair of generally perpendicular faces.

3. The exercise wedge of claim 2, wherein the handhold cutout formed at each end of the forward lateral edge comprises a generally vertical rear face.

4. The exercise wedge of claim 2, wherein the handhold cutout formed at each end of the upper lateral edge comprises a rearwardly inclined bottom face.

5. The exercise wedge of claim 2, wherein the handhold cutout formed at each end of the rear lateral edge comprises a rearwardly inclined upper face.

6. The exercise wedge of claim 1, wherein the ball socket and the bottom groove are of substantially the same diameter.

7. The exercise wedge of claim 6, wherein the upper groove has a diameter smaller than the diameter of the ball socket and bottom groove.

8. A method of using an exercise wedge, the exercise wedge comprising a generally triangular wedge of firm-but-resilient polymer foam, the wedge having a generally flat bottom face, a generally flat vertical rear face, a generally flat inclined front face, and upper, forward, and rear lateral edges defined at the junctions of the faces; a substantially hemispherical ball socket formed in the front face; a substantially semi-circular bottom groove extending from the front face to the rear face along the bottom face, the bottom groove having an axis substantially parallel to the bottom face and interrupting the forward and rear lateral edges; a substantially semi-circular upper groove extending from the front face to the rear face at the upper lateral edge, the upper groove interrupting the upper edge; and, wherein the upper, forward, and rear lateral edges are further interrupted at each of their ends by a handhold cutout, the method comprising placing one of the front, rear, or bottom faces of the wedge on a floor or mat, and placing a resilient exercise ball in one of the ball socket or the bottom groove and supporting portions of the user's body against the exercise ball, the wedge, and the floor or mat.

9. A method of using an exercise wedge, the exercise wedge comprising a generally triangular wedge of firm-but-resilient polymer foam, the wedge having a generally flat bottom face, a generally flat vertical rear face, a generally flat inclined front face, and upper, forward, and rear lateral edges defined at the junctions of the faces; a substantially hemispherical ball socket formed in the front face; a substantially semi-circular bottom groove extending from the front face to the rear face along the bottom face, the bottom groove having an axis substantially parallel to the bottom face and interrupting the forward and rear lateral edges; a substantially semi-circular upper groove extending from the front face to the rear face at the upper lateral edge, the upper groove interrupting the upper edge; and, wherein the upper, forward, and rear lateral edges are further interrupted at each of their ends by a handhold cutout, the method comprising placing one of the front or rear faces of the wedge on a floor or mat, and placing an elongated portion of a user's body in the bottom groove while bracing other portions of the user's body against the floor or mat.

10. A method of using an exercise wedge, the exercise wedge comprising a generally triangular wedge of firm-but-resilient polymer foam, the wedge having a generally flat bottom face, a generally flat vertical rear face, a generally flat inclined front face, and upper, forward, and rear lateral edges defined at the junctions of the faces; a substantially hemispherical ball socket formed in the front face; a substantially semi-circular bottom groove extending from the front face to the rear face along the bottom face, the bottom groove having an axis substantially parallel to the bottom face and interrupting the forward and rear lateral edges; a substantially semi-circular upper groove extending from the front face to the rear face at the upper lateral edge, the upper groove interrupting the upper edge; and, wherein the upper, forward, and rear lateral edges are further interrupted at each of their ends by a handhold cutout, the method comprising placing one of the front, rear or bottom faces of the wedge against a wall, and placing a user's hands in one of the sets of edge end cutouts while bracing the user's body against the wedge.

11. The method of claim 10, further comprising placing the front face of the wedge against the wall, and placing the user's forehead in the bottom groove.

* * * * *